US009980585B2

(12) United States Patent
Carr

(10) Patent No.: US 9,980,585 B2
(45) Date of Patent: May 29, 2018

(54) BED COVERING WITH ALIGNMENT INDICATORS AND METHOD OF FABRICATION

(71) Applicant: Myra J. Carr, Olathe, KS (US)

(72) Inventor: Myra J. Carr, Olathe, KS (US)

( * ) Notice: Subject to any disclaimer, the term of this patent is extended or adjusted under 35 U.S.C. 154(b) by 209 days.

(21) Appl. No.: 14/806,354

(22) Filed: Jul. 22, 2015

(65) Prior Publication Data

US 2016/0022062 A1 Jan. 28, 2016

Related U.S. Application Data

(60) Provisional application No. 62/027,557, filed on Jul. 22, 2014.

(51) Int. Cl.
*A47G 9/02* (2006.01)
*B41M 1/12* (2006.01)

(52) U.S. Cl.
CPC ..... *A47G 9/0246* (2013.01); *A47G 9/0238* (2013.01); *B41M 1/12* (2013.01); *A47G 2009/0276* (2013.01); *A47G 2200/125* (2013.01)

(58) Field of Classification Search
CPC .. A47G 9/0238; A47G 9/0246; A47G 9/0261; A47G 9/0284; A47G 9/0292; A47G 2200/125; A47G 2009/0269; A47G 2009/0276; B41M 1/12
See application file for complete search history.

(56) References Cited

U.S. PATENT DOCUMENTS 1,907,393 A * 5/1933 Tooley ..... G09F 3/14 40/631
2,695,414 A 11/1954 Ford
3,613,133 A * 10/1971 Isola ..... A47G 9/02 428/690
3,878,638 A * 4/1975 Benjamin ..... A63H 33/16 428/187
4,442,558 A * 4/1984 Alexander ..... A47G 9/02 5/482
4,802,250 A * 2/1989 Farr ..... A47G 9/0238 5/482
4,875,245 A * 10/1989 Isola ..... A47G 9/02 5/482

(Continued)

OTHER PUBLICATIONS

Arthritis Foundation, "Tips on Making Your Bed", www.arthritistoday.org, 2014, 1.

*Primary Examiner* — David E Sosnowski
*Assistant Examiner* — David R Hare
(74) *Attorney, Agent, or Firm* — Law Office of Mark Brown, LLC; Christopher M. DeBacker

(57) ABSTRACT

A method of updating existing screen printing or other manufacturing processing in order to generate sheets and other bedding with marking indicators for proper alignment of the covering on a mattress, and the covering as produced. For a top sheet it would be marked along the top edge of the sheet as well as the body of the sheet which contacts the corners of the mattress at the foot of the bed, and for a fitted bottom sheet the markings would occur at each corner of the sheet which is associated with a corner of the mattress. Optional side indicators located between the corner indicators may also be included. The purpose is to provide a quick and easy identifier for locating the corners of the mattress with the sheet so that the sheet is quickly and easily placed symmetrically upon the mattress the first time.

5 Claims, 5 Drawing Sheets

(56) References Cited

U.S. PATENT DOCUMENTS 4,934,939 A * 6/1990 Bonneville ..... G09B 19/00 434/247
5,018,232 A 5/1991 Schetti
5,070,561 A * 12/1991 Keidser ..... A47G 9/0284 5/482
5,208,926 A * 5/1993 Stackhouse ..... A47C 21/022 5/482
5,457,830 A * 10/1995 Fox ..... A47G 9/02 5/486
5,655,236 A * 8/1997 Murray ..... A47G 9/0238 5/482
5,664,269 A * 9/1997 Broder ..... A47G 9/0207 5/482
6,158,777 A * 12/2000 Twardosz ..... G09B 29/04 281/2
6,230,341 B1 * 5/2001 Dudley ..... A47G 9/02 5/482
7,194,958 B2 * 3/2007 Brasier ..... A47G 9/0238 101/485
7,302,721 B1 12/2007 Dorr
7,761,940 B2 7/2010 Hipp
7,938,133 B2 * 5/2011 Vondohlen ..... E04H 15/42 135/115
8,336,137 B2 * 12/2012 Aprile ..... A47G 9/0246 5/495
8,438,679 B2 * 5/2013 Wootten, Jr. ..... A47G 9/0246 5/482
8,516,631 B1 * 8/2013 Conley ..... A47G 9/02 5/482
9,601,034 B2 * 3/2017 Jensen ..... G09F 3/00
2001/0032361 A1 10/2001 Schreiner
2011/0173750 A1 7/2011 Lehmann
2012/0060283 A1 * 3/2012 Campasano ..... A47G 9/0238 5/495
2012/0096643 A1 * 4/2012 Shuff ..... A47G 9/0238 5/486

* cited by examiner

BED COVERING WITH ALIGNMENT INDICATORS AND METHOD OF FABRICATION

CROSS-REFERENCE TO RELATED APPLICATION

This application claims priority in U.S. Provisional Patent Application No. 62/027,557 filed Jul. 22, 2014, which is incorporated herein by reference.

BACKGROUND OF THE INVENTION

1. Field of the Invention

The present invention relates generally to a bed covering, and more specifically to a bed covering with alignment features placed onto the covering during automated fabrication processes.

2. Description of the Related Art

Existing bed sets and bed sheets are difficult to align onto standard mattresses due to their size and often, as is the case with queen and king sized beds, their shape. It can be difficult for a single person to change sheets and bedding and ensure that the sheets and bedding are properly aligned with the corners of the mattress without constantly readjusting the sheets and bedding.

Heretofore there has not been available a system or method for aligning bedding on a bed with the advantages and features of the present invention.

SUMMARY OF THE INVENTION

The present invention generally provides a method of updating existing screen printing or other manufacturing processing in order to generate sheets and other bedding with marking indicates for proper alignment of the bedding on a mattress. The present invention may also simply be applied to sheets as they are manufactured, and not necessarily to existing screen printing. The purpose of updating or applying printing to the sheets is to mark the sheets at the corners where the sheet would optimally come into contact with a corner of a mattress. For a top sheet it would be marked along the top edge of the sheet as well as the body of the sheet which contacts the corners of the mattress at the foot of the bed, and for a fitted bottom sheet the markings would occur at each corner of the sheet which is associated with a corner of the mattress. Optional side indicators located between the corner indicators may also be included. The purpose is to provide a quick and easy identifier for locating the corners of the mattress with the sheet so that the sheet is quickly and easily placed symmetrically upon the mattress the first time.

This invention could apply to all bed coverings, including top sheets, bottom ("fitted") sheets, duvet covers, quilts, blankets, or any similar covering. The invention is suitable for bed coverings of all sizes.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Bedding Alignment System 2

Figure 2:
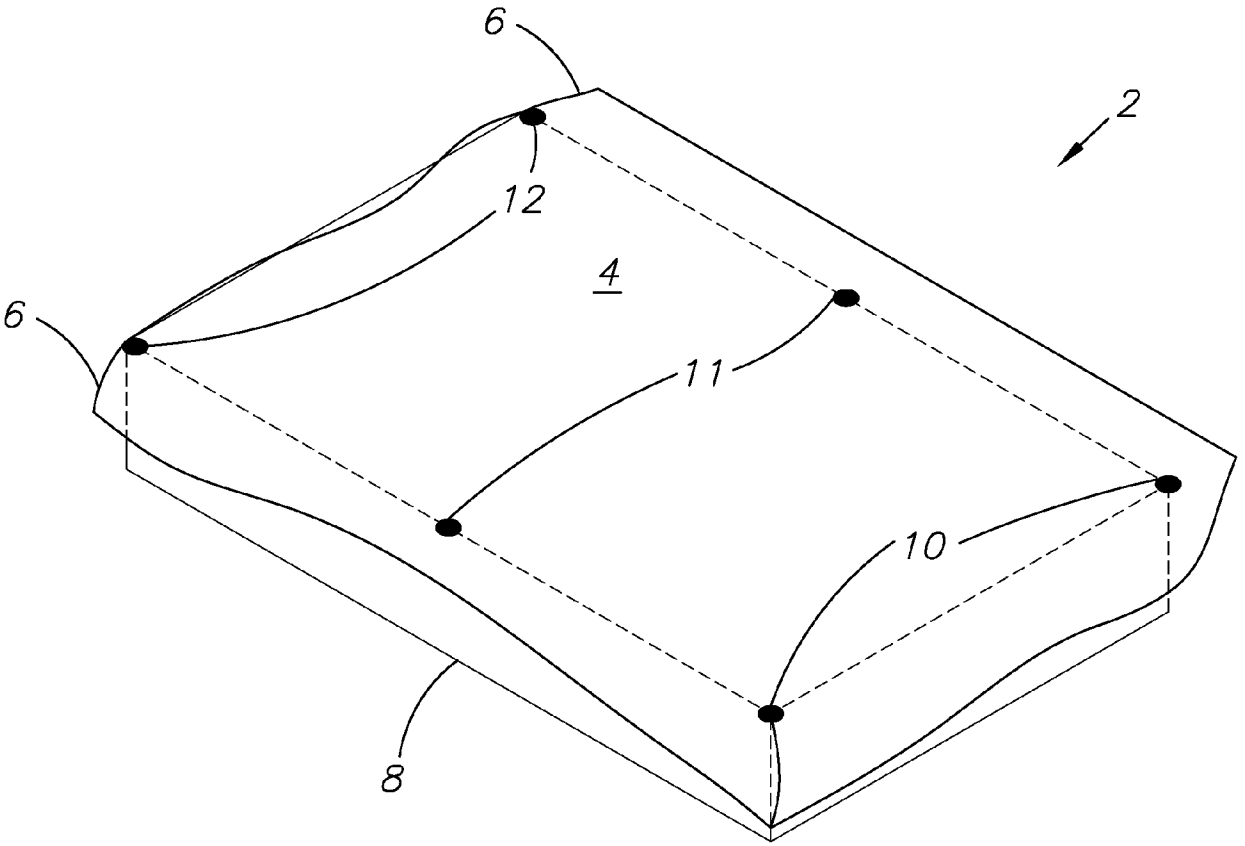
FIG. 2 is a three-dimensional isometric view thereof.

Referring to the drawings in more detail, FIG. 2 shows a preferred embodiment bedding alignment system 2 including at least a sheet 4 having sheet edges 6 overhanging mattress edges 8. A number of alignment indicators 10, 11, 12 are physically located on the sheet 4 at points which correspond with the mattress edges 8.

The alignment indicators 10, 11, 12 in a preferred embodiment are printed onto the sheet 4 using a typical screen-printing process. If a pattern is printed to the sheets during manufacturing, the indicators 10, 11, 12 can be worked into the pattern using appropriate software. Alternatively, the indicators 10, 11, 12, may be printed on top of an existing pattern. The flowchart shown in FIG. 4 goes into additional detail on these steps.

The indicators can be located at the corners or along the sides corresponding with the mattress edges. The top indicators 12 of the top sheet 4 are aligned with the top corners of the mattress 8. The bottom indicators 10 of the top sheet 4 are similarly aligned with the bottom corners of the mattress 8, and excess sheet edge 6 hangs from that end of the mattress. The middle indicators 11 are optional, but provide further accuracy in aligning the bed sheet.

The indicators may also be physically raised elements, such as embossments of company logos or sheet sizes sewn directly into the sheet fabric (e.g. "Q" or "QUEEN" for a queen-sized sheet). The indicators may also be buttons, snaps, or other physical elements attached to the sheet material.

Figure 1:
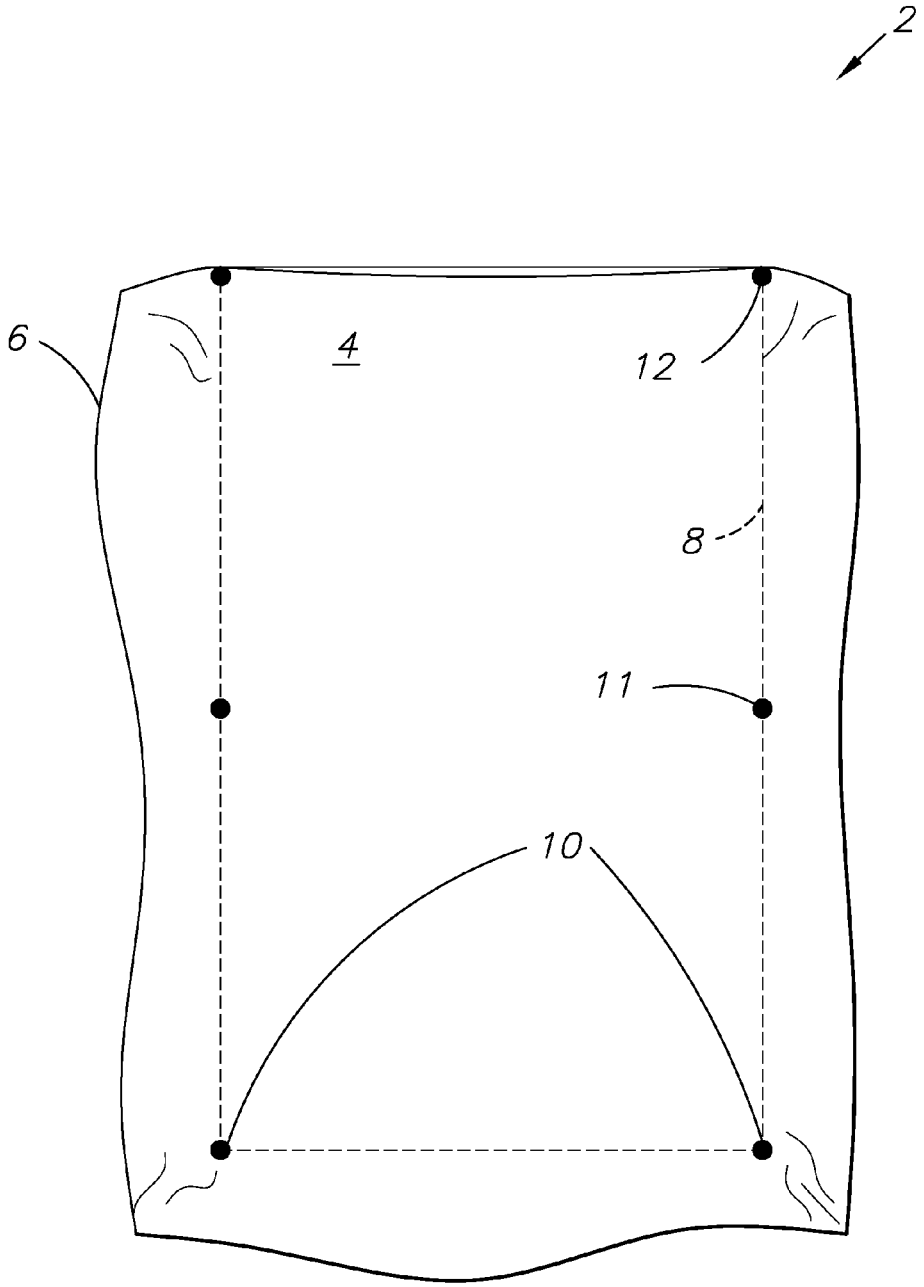
FIG. 1 is a top plan view of a preferred embodiment of the present invention.

While the above and FIGS. 1-2 apply to a top sheet, a similar pattern and application method would apply to all top bed coverings, including duvet covers, blankets, quilts, and the like, where the top edge of the covering is intended to terminate at the head of the mattress.

Figure 3:
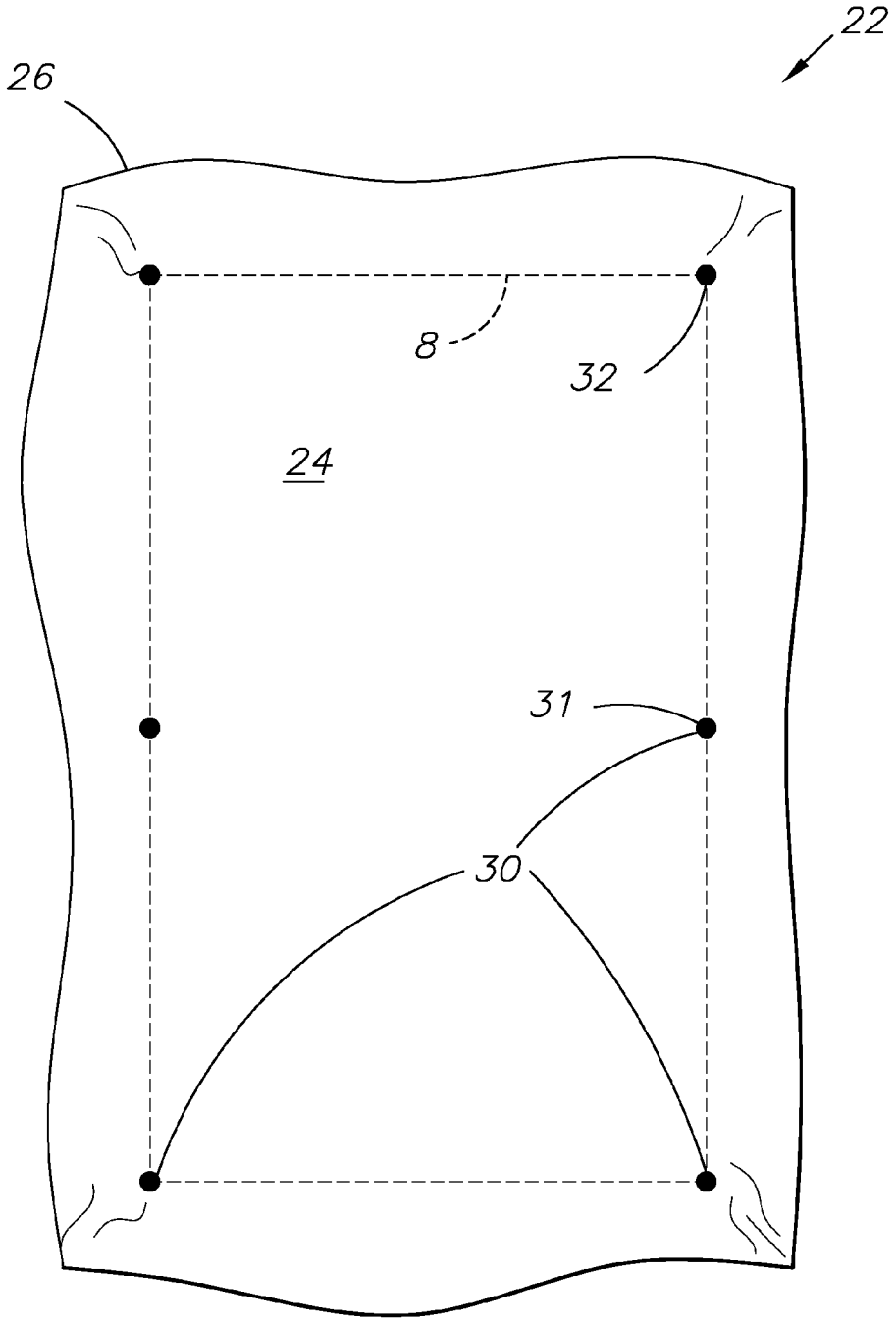
FIG. 3 is a top plan view of an embodiment of the present invention including a fitted bottom sheet.

FIG. 3 shows an alternative sheet indicator system 22 where the indicators 30, 31, 32 are on a bottom sheet 24 (also known as a "fitted sheet") instead of the flat sheet of FIGS.

1 and 2. As the fitted sheet 24 has edges 26 which hang over the mattress 8 on all sides, the top indicators 32 are not located along the top edge of the sheet, but rather mirror those of the bottom indicators 30. The middle indicators 31 remain very much the same as in the previous embodiment. The alignment technique is the same. The middle indicators 31 may help direct the users to determine which direction the sheet is supposed to be placed onto the mattress 8.

Figure 4:
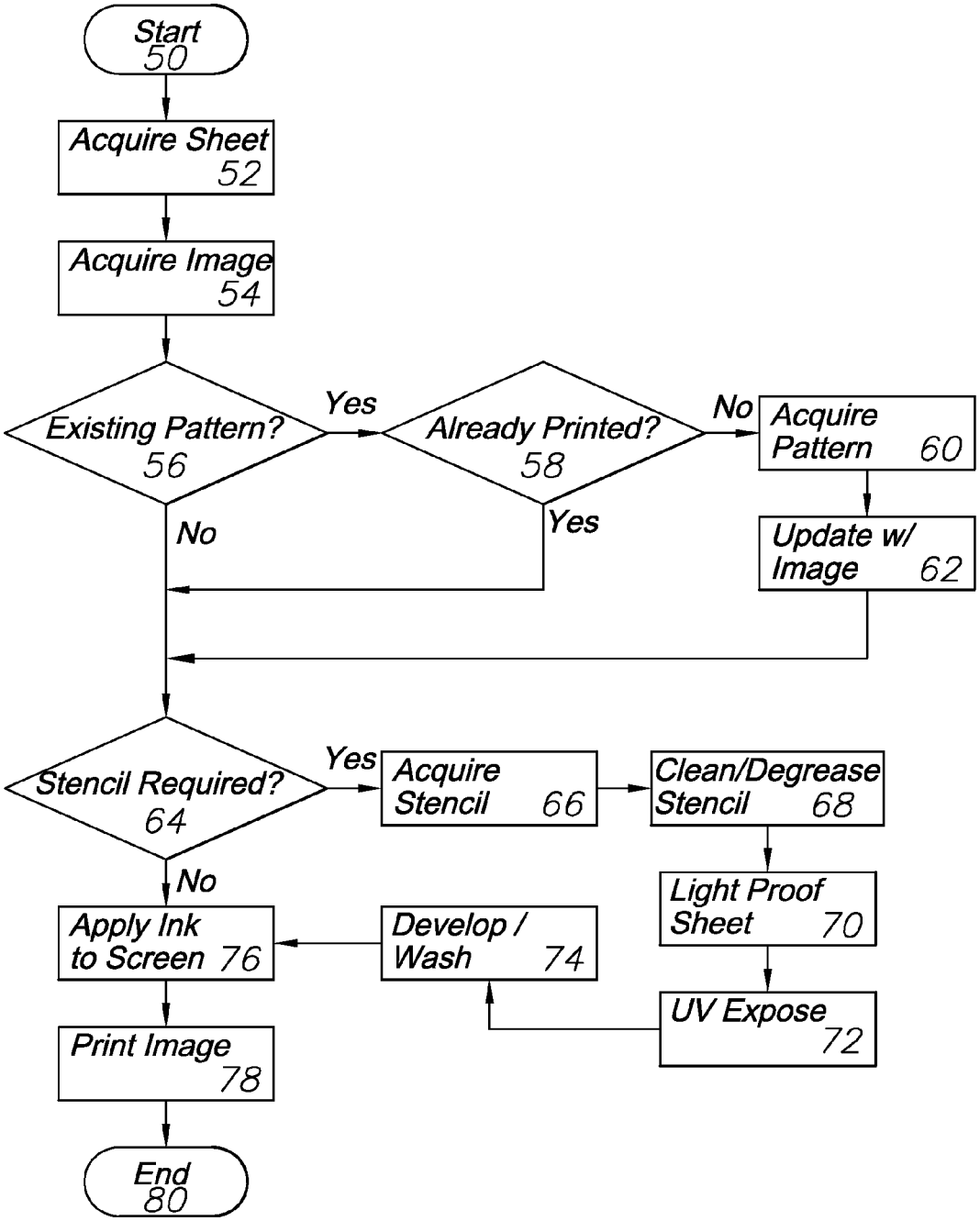
FIG. 4 is a flowchart diagramming the method of practicing an embodiment of the present invention.

FIG. 4 is a flowchart diagramming steps taken to print an image to a sheet. Similar steps may be taken for embossing or otherwise applying alternative markings to the sheets or other bed coverings. The printing process is implemented into existing automated sheet printing software technology, and is therefore coordinated by a computer having a processor and data storage for storing the software protocols. A user interface would be necessary to choose images or otherwise indicate options within the software program.

The method starts at step 50, and a sheet is acquired at 52. The sheet may be fed into a machine automatically or otherwise acquired and put into place. The desired image to be placed on the sheet at the indicator locations is chosen at 54. This may be automated if, for example, the size of the sheet is being printed onto the indicator locations (e.g. "Q" or "Queen" for a queen sized sheet).

The system detects if the sheet has an existing pattern at 56. If yes, the system then detects whether that pattern has already been printed at step 58. If there is an existing pattern that must be applied to the sheet at 56 but the pattern has not yet been applied at 58, then the pattern image must be acquired at 60 and will be updated to include the indicator image at 62. This process introduces the printed image of the indicator into the actual pattern of the sheet.

Once this occurs, or if the image has already been printed at step 58, or if there is no pattern at 56, then the system determines whether a stencil is required for the pattern and/or the indicator at 64. If a stencil is required, it is acquired or generated at 66. The stencil may be created manually or photochemically using an image place. The stencil must be cleaned and degreased at 68 to ensure that it does not stick to the screen.

A light proof positive is made using clear acetate at 70 and the stencil is placed over the light-sensitive coating. Timed exposure to UV light occurs at 72, which hardens only the exposed parts of the film coating. Areas of emulsion which are concealed on the stencil with the positive image remain soft from this process.

The sheet is developed and washed at 74. The development process further hardens the exposed parts of the film stencil, and upon washing the emulsion with warm water, the soft areas of film emulsion dissolve and disappear to leave a negative stencil which is the exact opposite of the positive image. This stencil can then be applied to the sheet which, when printed, will result in an exact likeness to the original positive image, including the pattern if part of the stencil.

Once this occurs, or if no stencil is required, the ink is applied to the screen at 76 and the image is printed to the sheet at 78, including the indicators. The process then ends at 80 with the final image appearing on the sheet.

A similar process could occur with raised emblems or the installation of buttons on a sheet at the desired locations. These processes could easily be automated using a modified process of the example shown in FIG. 4.

On major element of the present invention is to update existing sheet manufacturing and printing software to incorporate the pattern associated with the alignment system presented herein.

Figure 5:
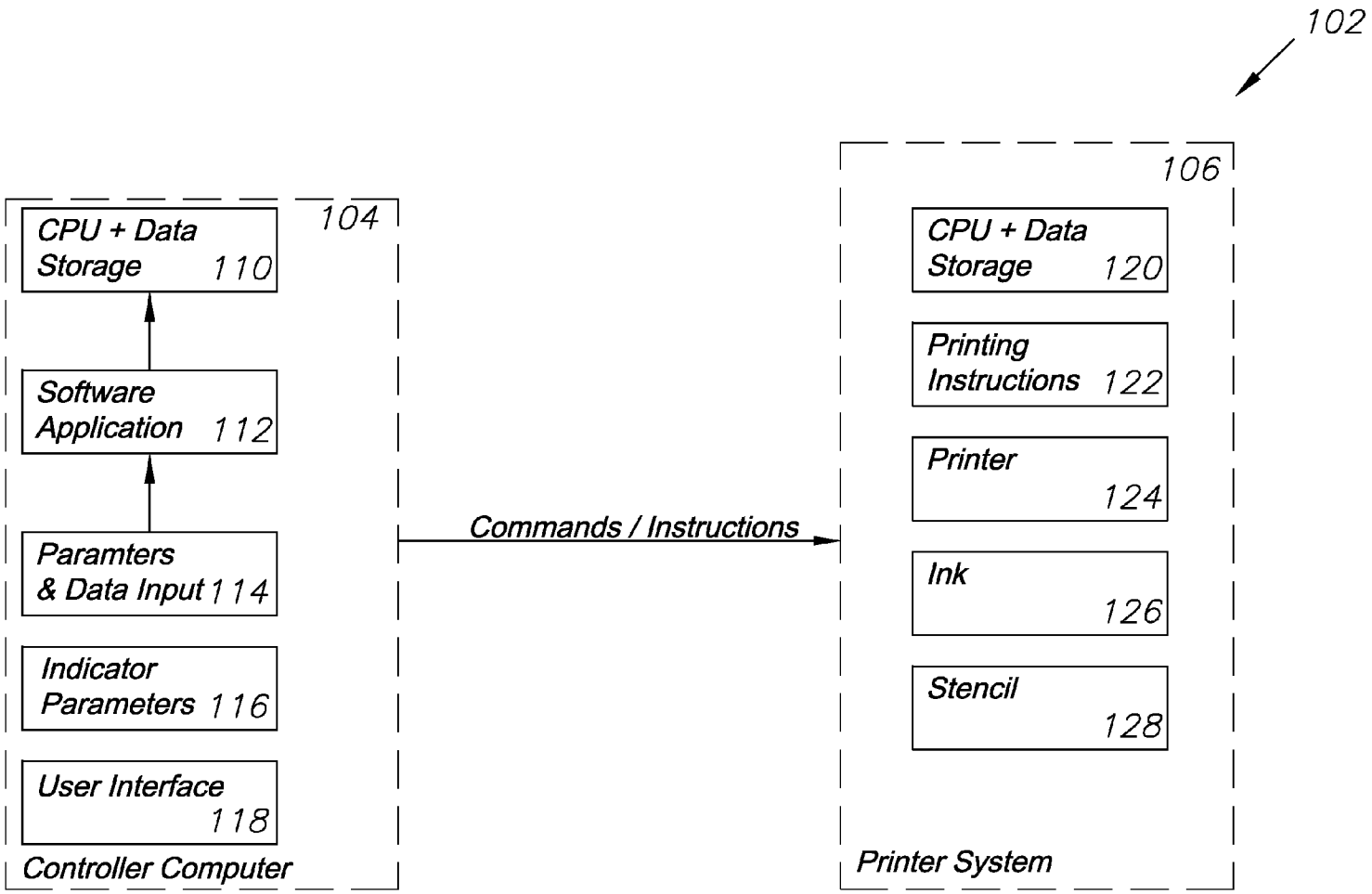
FIG. 5 is a diagrammatic representation of computer and software elements which interact with elements of the present invention.

FIG. 5 demonstrates diagrammatically how the computer elements interact with the printing elements to create an embodiment of the present invention. In an example computer printing system 102, a controller computer 104 communications printing commands and instructions to the printer system 106.

The controller computer 104 includes at least a CPU and data storage 110 storing and accessing a software application 112 as defined above which interprets or allows access to various parameters and data inputs 114 selected by a user.

The indicator parameters 116 entered by the user are added to other patterns or other parameters already existing in the printing system. A user interface 118 such as a mouse and keyboard allows a user to customize, update, and control the printing process via the controller computer 104.

The printer system 106 may or may not have its own unique CPU and data storage 120. The printer could use the CPU and data storage 110 of the controller computer 104 alternatively.

Printing instructions 122 are received by the printer system. Other common elements as discussed above include the printer 124 itself, ink 126, and optional stencils 128 and stencil-manufacturing equipment.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A computer implemented method of marking bed coverings, the method comprising the steps:

applying a set of indicator parameters to an existing set of print parameters within a software application stored on a controller computer having a CPU, data storage, and a user interface (UI), said indicator parameters including a visual image;

communicating with said controller computer to a printer system instructions to print said print parameters including said indicator parameters;

generating a stencil for applying said indicator parameters;

applying said stencil to a bed covering placed within said printer system;

printing a first pair of alignment indicators at a first location of said stencil upon said bed covering, wherein said first location is associated with a first portion of said covering which would come into contact with respective bottom corners of an upper side of a mattress;

printing a second pair of alignment indicators at a second location of said stencil upon said bed covering, wherein said second location is associated with a second portion of said covering which would come into contact with respective midpoints along a upper side edges of the mattress;

printing a third pair of alignment indicators at a third location of said stencil upon said bed covering, wherein said third location is associated with a third portion of said covering which would come into contact with respective top corners of the upper side of the mattress;

wherein said first, second, and third pairs of alignment indicators are configured to indicate alignment of said bed covering with said mattress; and wherein said first, second, and third alignment indicators comprise raised elements.

2. The computer implemented method of claim 1, further comprising the step:

updating existing software within said software application with software programming configured to print said indicator.

3. The computer implemented method of claim 1, wherein said indicator comprises an image.

4. The computer implemented method of claim 3, wherein said image is an alphanumeric image.

5. The computer implemented method of claim 4, wherein said alphanumeric image corresponds with the size of the covering.

* * * * *